US011220111B2

(12) United States Patent
Cantrell et al.

(10) Patent No.: US 11,220,111 B2
(45) Date of Patent: Jan. 11, 2022

(54) INK CARTRIDGE CAPS

(71) Applicant: HEWLETT-PACKARD DEVELOPMENT COMPANY, L.P., Spring, TX (US)

(72) Inventors: John J. Cantrell, Vancouver, WA (US); Keith Jariabka, Vancouver, WA (US); Theodore J. Conley, Vancouver, WA (US); William S. Osborne, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 116 days.

(21) Appl. No.: 16/499,256

(22) PCT Filed: Oct. 20, 2017

(86) PCT No.: PCT/US2017/057745
§ 371 (c)(1),
(2) Date: Sep. 28, 2019

(87) PCT Pub. No.: WO2019/078899
PCT Pub. Date: Apr. 25, 2019

(65) Prior Publication Data

US 2021/0291536 A1 Sep. 23, 2021

(51) Int. Cl.
*B41J 2/175* (2006.01)

(52) U.S. Cl.
CPC ..... *B41J 2/17509* (2013.01); *B41J 2/17553* (2013.01)

(58) Field of Classification Search
CPC ..... B41J 2/17509; B41J 2/17553
See application file for complete search history.

(56) References Cited

U.S. PATENT DOCUMENTS

| | | | | |
|---|---|---|---|---|
| 4,798,485 | A | 1/1989 | Onoda et al. | |
| 5,509,140 | A | 4/1996 | Koitabashi et al. | |
| 6,158,849 | A | 12/2000 | Veciana et al. | |
| 6,367,918 | B1 | 4/2002 | Heiles et al. | |
| 6,779,875 | B2 | 8/2004 | Pawlowski et al. | |
| 7,114,801 | B2 | 10/2006 | Hall et al. | |
| 7,278,719 | B2 | 10/2007 | Scardov et al. | |
| 9,573,380 | B2 | 2/2017 | Ishida et al. | |
| 2003/0169318 | A1 | 9/2003 | Kline et al. | |
| 2005/0151799 | A1 | 7/2005 | Kosciesza | |
| 2015/0191020 | A1 | 7/2015 | Tominaga et al. | |
| 2015/0360476 | A1* | 12/2015 | Osakabe | B41J 2/17513 347/85 |
| 2016/0089893 | A1* | 3/2016 | Osakabe | B41J 29/13 347/85 |
| 2018/0281427 | A1* | 10/2018 | Shimano | B41J 29/38 |

FOREIGN PATENT DOCUMENTS

| | | |
|---|---|---|
| CN | 104772990 | 7/2015 |

* cited by examiner

*Primary Examiner* — Justin Seo
(74) *Attorney, Agent, or Firm* — HP Inc. Patent Department

(57) ABSTRACT

An example ink tank includes a cap with a preloaded hinge that biases the cap to a fully opened position when the cap is unlatched. The cap in the fully opened position interferes with and prevents the closure of a door that provides access to the ink tank. The door includes a sensor that locks out the print function when the door is open, effecting a printer lockout when the cap of the ink tank is opened for filling.

15 Claims, 14 Drawing Sheets

(section A-A)

INK CARTRIDGE CAPS

BACKGROUND

Printers are commonplace, whether in a home environment or an office environment. Such printers can include laser printer, inkjet printers or other types. Generally, printers require at least one consumable, such as paper or ink. Ink may be provided for the printers in cartridges that may be replaceable or refillable.

BRIEF DESCRIPTION OF THE DRAWINGS

For a more complete understanding of various examples, reference is now made to the following description taken in connection with the accompanying drawings in which.

DETAILED DESCRIPTION

Bubbler-style tanks for inkjet printers require a seal at the ink fill port during printing to create and maintain the negative back pressure required to prevent excessive ink flow due to gravity when the ink supply is located above the print head assembly. Users must open the seal to refill the ink tank, so a secondary seal may be used at the outlet of the ink tank to prevent ink flow. Inadvertent printing during the open and fill cycle can cause air ingestion into the print head assembly from high negative back pressure in any feeder tanks below the secondary seal.

To address the issues described above, various examples provide for printer lockout during ink refill operations. The example lockout system includes a sensor that detects when an access door to the ink tank bay is opened and disables the printing function. When the user opens an ink tank to refill the ink tank, the cap of the ink tank is automatically forced to a fully opened state by a pre-loaded hinge. In that fully opened state, the cap interferes with the access door and prevents it from closing, so the printing function cannot be enabled while the ink tank is open. In some examples, the ink tank may have an internal valve to effect a secondary seal that is mechanically actuated by opening the cap. In other examples, the cap may include a cap housing and an internal, spring-loaded bung that maintains a seal on the ink tank while the cap housing transitions through a position that actuates the secondary seal while the ink tank is still sealed.

Accordingly, the present disclosure describes example apparatus, methods and systems to facilitate printer lockout during ink refill operations and to provide for automatically engaging secondary seals during ink refill operations.

Figure 1:
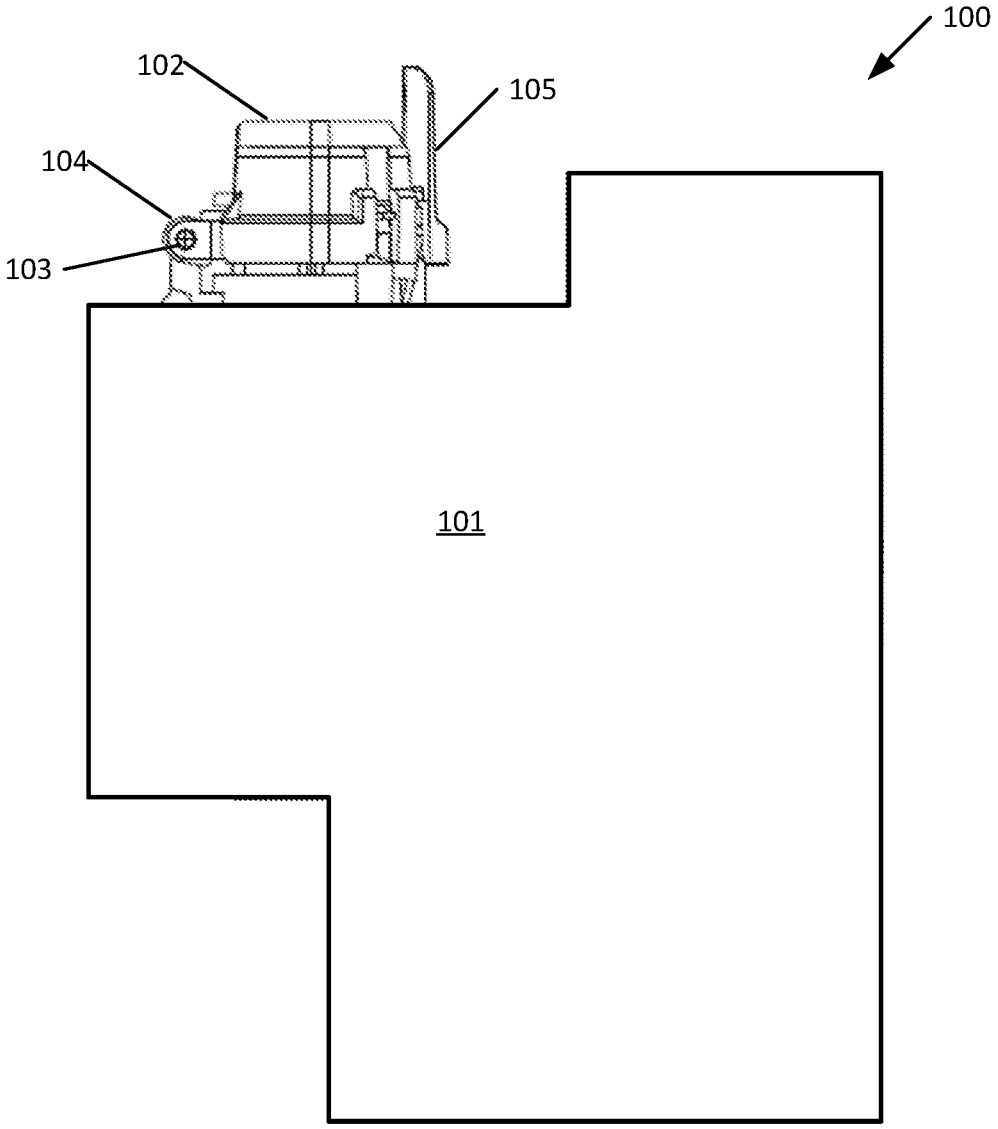
FIG. 1 is a side view of an example ink tank.

Referring now to the figures, FIG. 1 illustrates a side view of an example ink tank 100. Example ink tank 100 includes an ink tank body 101, which may be a multi-chambered ink tank as described in greater detail below. The example ink tank 100 also includes a cap assembly 102 attached to the ink tank 100 with a hinge, such as hinge 103 illustrated in FIG. 1. In the example illustrated in FIG. 1, the cap assembly 102 is shown in a latched (closed) state. Cap assembly 102 may be attached to the example ink tank 100 by the hinge 103. Hinge 103 may be any type of hinge that constrains the rotation of the cap assembly 102 to a single axis of rotation. In one example, hinge 103 may be an axle engaged with cylindrical bearings extending from the cap assembly 102. Example ink tank 100 also includes an elastic band 104 disposed around the hinge 103 to apply an opening force to the cap assembly 102 such that when the cap assembly 102 is unlatched, the opening force applied by the elastic band 104 rotates the cap assembly 102 to a fully opened position and maintains the cap assembly 102 in the fully opened position until the force is overcome by force applied by a user to close the cap assembly 102. Example ink tank 100 also includes a latch 105 to hold the cap assembly 102 in a closed position against the opening force applied by the elastic band 104 as illustrated in FIG. 1. Accordingly, the cap assembly 102 is constrained to two states; a closed state (closed position) as illustrated in FIG. 1 when the latch 105 is engaged, and a fully opened state (fully opened position) when the latch is released, as described and illustrated below. In various examples, as described in greater detail below, when the cap assembly 102 is in the fully opened state, the cap assembly 102 prevents the closure of an access door of a printer (not shown in FIG. 1) when the ink tank 100 is installed in the printer. The preventing of the closure of the access door by the cap assembly 102 effects a printer lockout.

Figure 3:
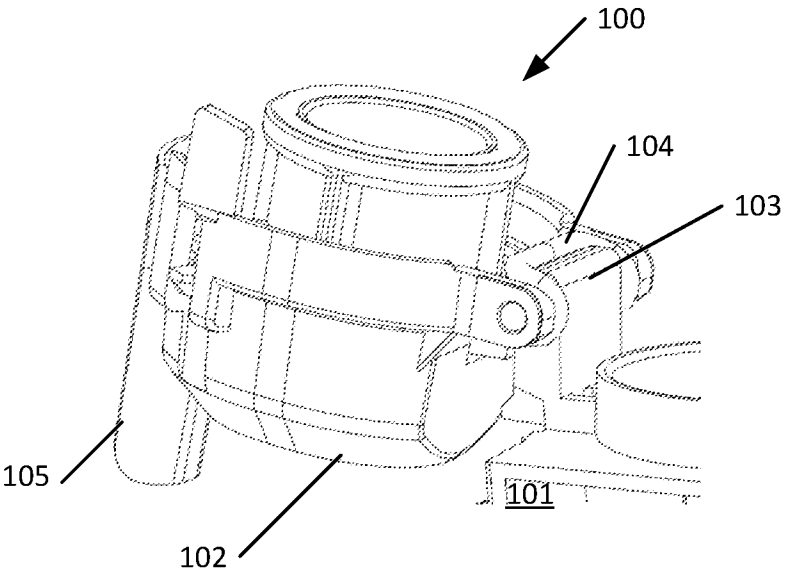
FIG. 3 is a perspective illustration of an example ink tank with an open cap.
Figure 2:
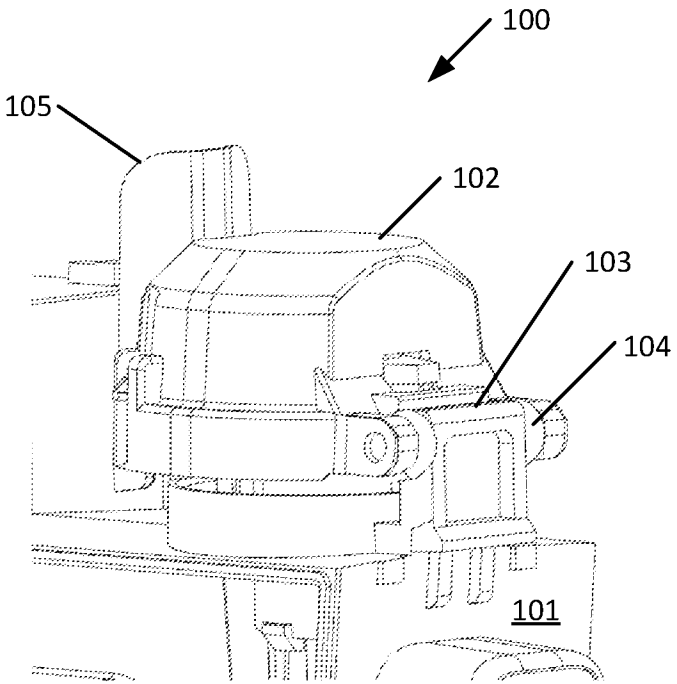
FIG. 2 is a perspective illustration of an example ink tank with a closed cap.

For greater clarity in describing the disposition and function of the elastic band 104, FIG. 2 is a perspective illustration of the ink cap assembly 102 in the closed position, and FIG. 3 is a perspective illustration of the example ink tank 100 with the cap assembly 102 in the fully opened position. It will be appreciated from these views that the elastic band 104 wraps around the ends of the axle of hinge 103 (as illustrated in FIG. 3) and under the arms of the hinge 103 (as illustrated in FIG. 3) to force to the cap assembly 102 to the fully open position as illustrated in FIG. 3.

Figure 4:
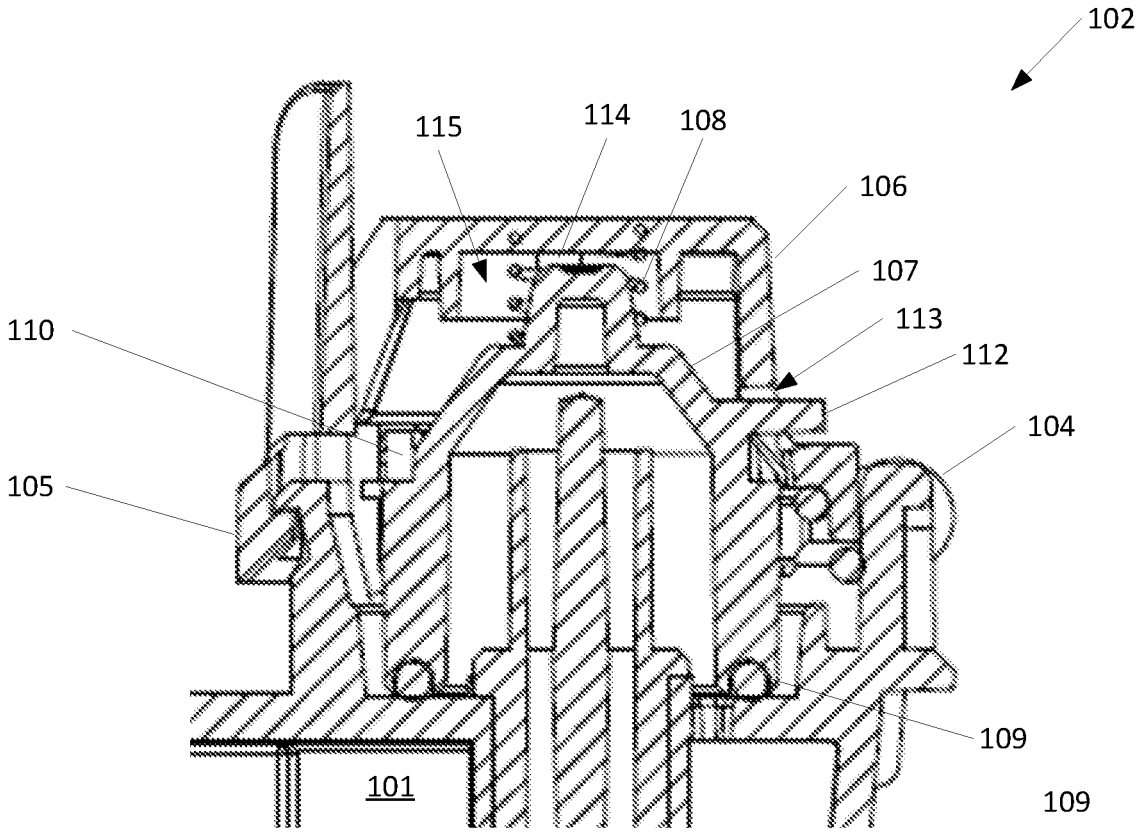
FIG. 4 is a sectional view of an example cap assembly in a closed position.
Figure 5:
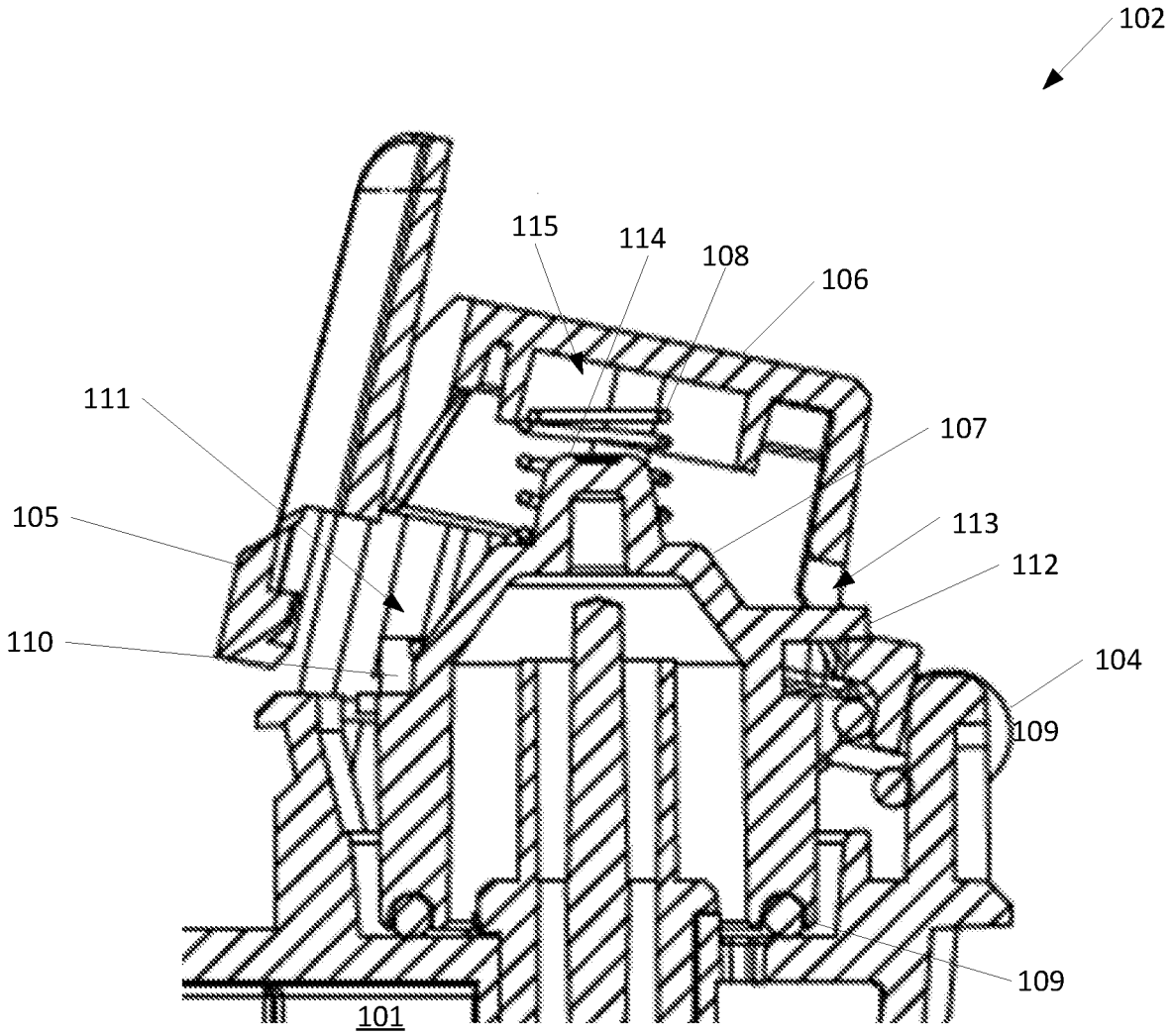
FIG. 5 is a sectional view of an example cap assembly in a partially opened position.

FIG. 4 is a sectional view of an example cap assembly 102 illustrating internal details of cap assembly 102 in the closed position, and FIG. 5 is a sectional view illustrating the cap assembly 102 of FIG. 4 in a transient, partially open state after the cap assembly 102 has been unlatched by the operation of latch 105. As illustrated in FIG. 4, the cap assembly includes a cap housing 106, a bung 107 retained within the cap housing 106, and a spring 108 disposed between the cap housing 106 and the bung 107. In one example, and without limitation, cap housing 106 may be fabricated from an acetal homopolymer thermoplastic such as Delrin,® and the bung 107 may be fabricated from a natural or synthetic elastic polymer such as natural rubber or silicone rubber. Also shown in FIG. 4 are the ink tank body 101 (partial), the elastic band 104, and the latch 105, previously described.

In the closed (latched) position illustrated in FIG. 4, the spring 108 is compressed between the cap housing 106 and the bung 107 and applies a sealing force between the bung 107 and the ink tank body 101. In one example, the bung 107 may include an O-ring 109 to improve the seal between the bung 107 and the ink tank body 101. As shown in FIG. 4, the bung 107 is retained within cap housing 106 by a number of complementary features comprising tabs or protuberances from the bung 107 and openings, cavities or channels in the cap housing 106. These include tab 110 of the bung 107 in a channel 111 of the cap housing (hidden in FIG. 4, but visible in FIG. 5), tab 112 of the bung 107 in opening 113 of the cap housing 106, and crown 114 of the bung 107 in cavity 115 of the cap housing 106. It will be appreciated that these complementary features will allow for relative motion between the cap housing 106 and the bung 107 when the cap assembly 102 is unlatched, as described below.

As noted, FIG. 5 is a sectional view illustrating the cap assembly 102 of FIG. 4 in a transient, partially open state after the cap assembly 102 has been unlatched by the operation of latch 105. This transient state is achieved by the combined forces of spring 108 and hinge 104. When latch 105 is released, spring 108 applies a force to push the cap housing 102 away from the bung 107 while maintaining a sealing force between the bung 107 and the ink tank body 101. It will be appreciated that this force decreases as spring 108 decompresses and that the relative motion of the cap housing 106 and the bung 107 is limited by the complementary features of the cap assembly 106 and the bung 107 described above.

In the transient state shown in FIG. 5, tab 112 is constrained by opening 113, the crown 114 (with spring 108) has moved within cavity 115, and tab 110 has reached the lower bound of channel 111, which limits further relative motion between the cap housing 106 and the bung 107. In one example, described in greater detail below, this transient position serves to actuate a valve in the ink tank (using other features of the cap housing 102) to effect a secondary seal in the ink tank body 101 before the seal between the bung 107 and the ink tank 101 is broken. After the cap assembly 102 reaches the transient position illustrated in FIG. 5, further motion of the cap assembly 102 is controlled by the force applied to the cap assembly 102 by the elastic band 104. As described previously, this force rotates the cap assembly to a fully open position.

Figure 6:
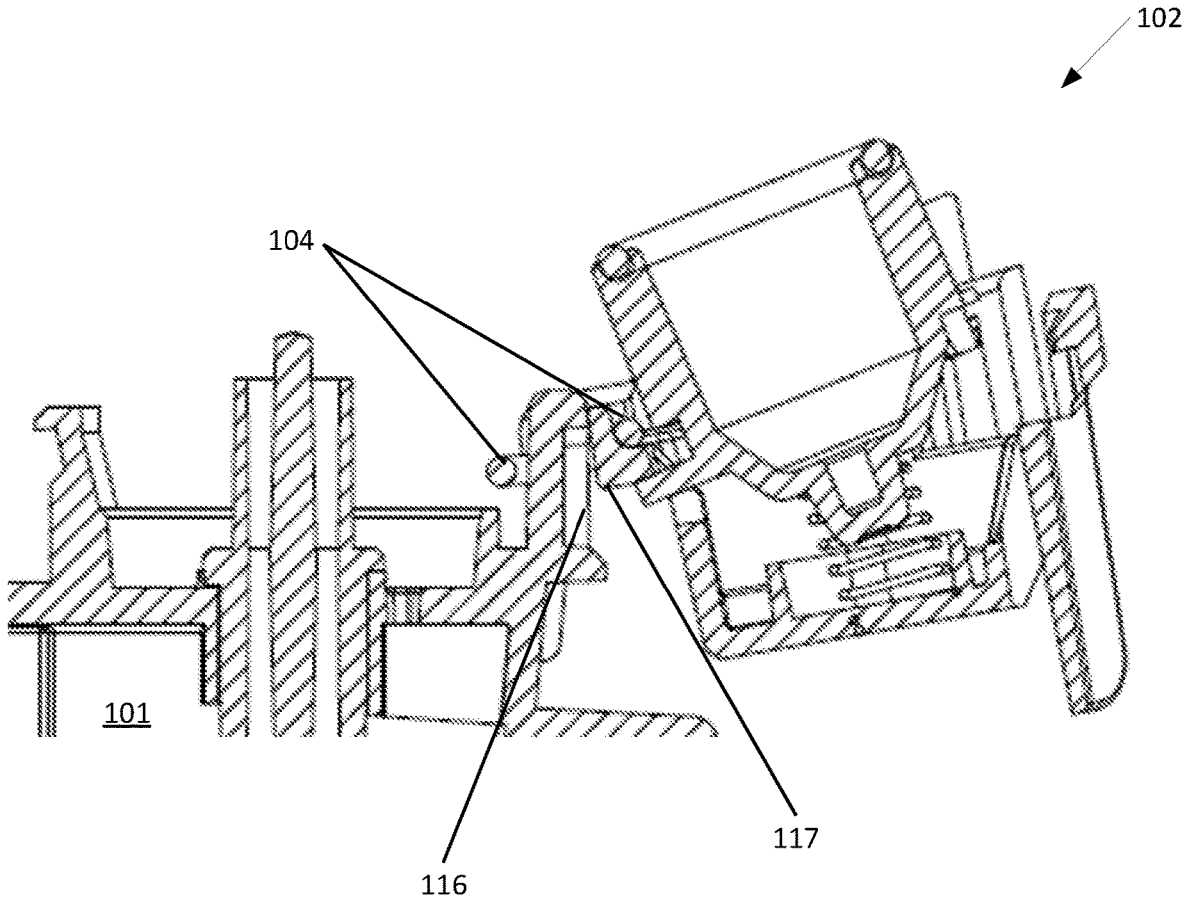
FIG. 6 is a sectional view of an example cap assembly in a fully opened position.

FIG. 6 is a sectional view illustrating the cap assembly 102 of FIGS. 4 and 5 in the fully open state. In this state, further rotation is limited by interference between a sidewall 116 of the ink tank body 101 and a flange 117 of the hinge 103 (not visible in FIG. 6).

Figure 7:
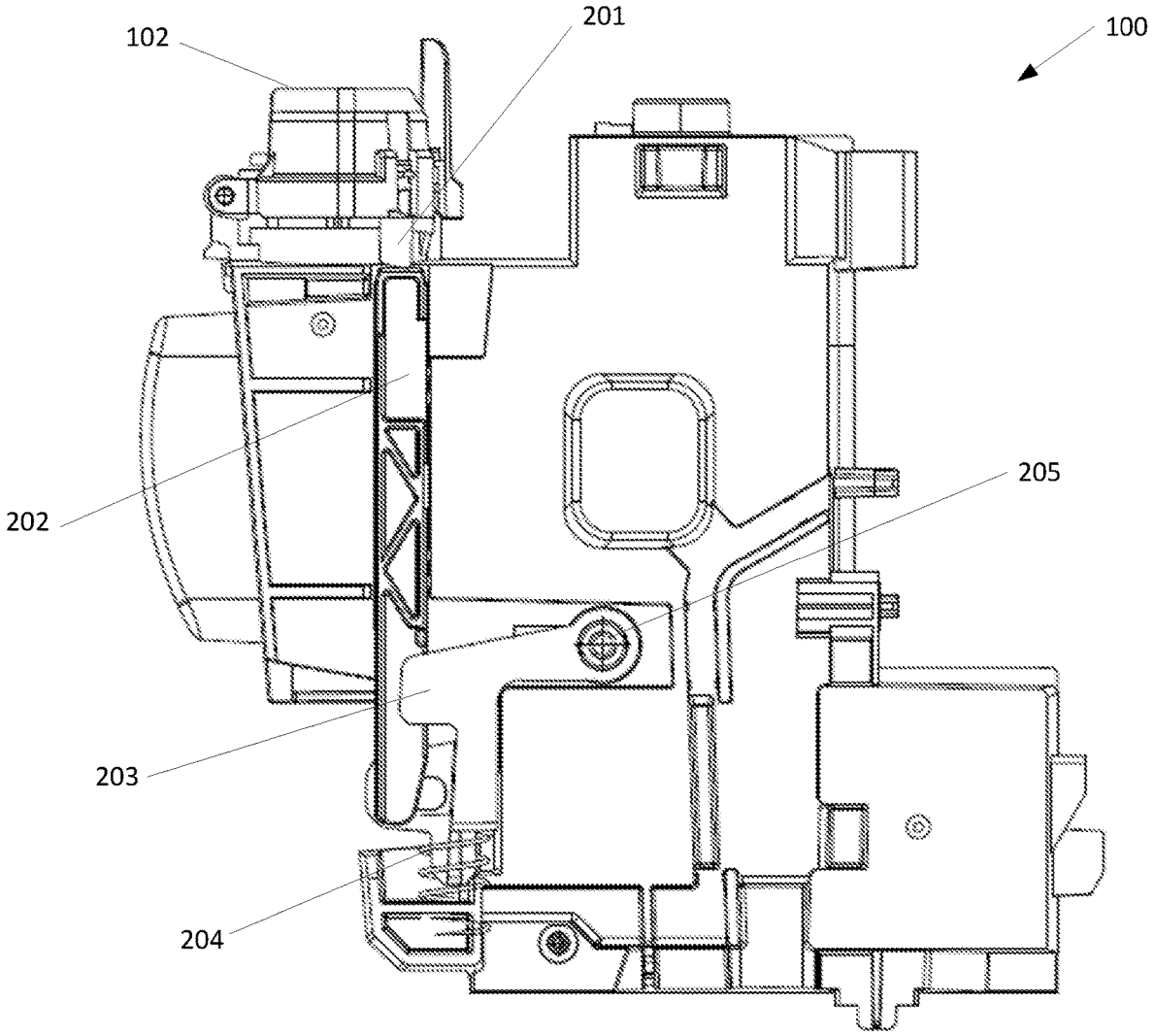
FIG. 7 is a side view of an example ink tank.

Turning now to a description of the secondary sealing mechanism referenced above with respect to the opening of the cap assembly 102, FIG. 7 illustrates the side view of the example ink tank 100 previously illustrated in FIG. 1. In the example of FIG. 7, the cap assembly 102 is in the closed (latched) state. In this state, an effector 201 (an extension of cap assembly 102) extends downward from the cap assembly 102 to depress a slider 202, which is retained in a channel in the body of the ink tank 100. The slider may be retained by any means known in the art, such as by channels or tabs, for example. In this position, the slider 202 is engaged with a cam on lever arm 203 that is spring loaded by a spring 204, and holds the lever arm 203 in a downward position against the force of the spring 204. Lever arm 203 is fixed to a sealed pinion 205 that extends into the interior of the ink tank body 101.

Figure 8:
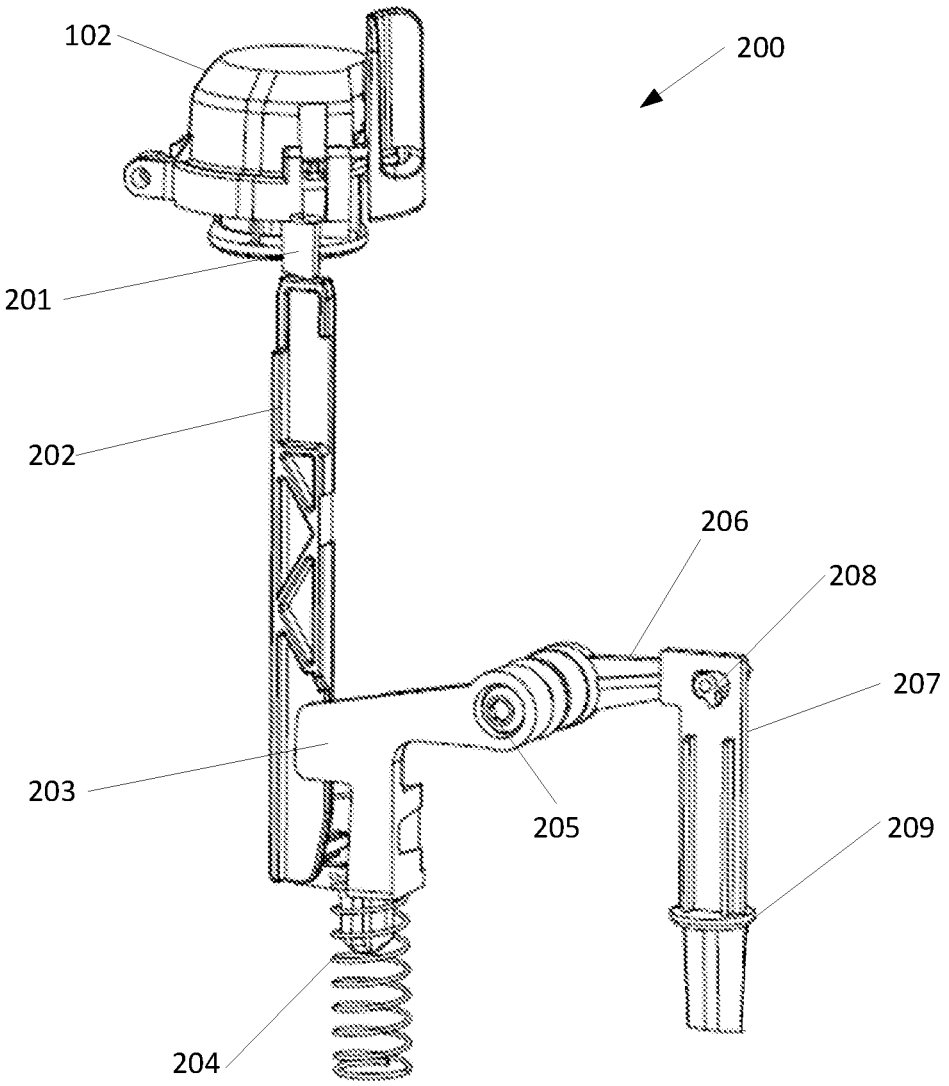
FIG. 8 is a perspective illustration of an example valve linkage.

FIG. 8 is a perspective illustration of the linkage described above, in isolation, showing additional details not visible in FIG. 7. In FIG. 8, the sealed pinion 205 is fixed to a second lever arm 206, which in turn is connected to a valve body 207 by a pin 208 that is fixed with respect to lever arm 206 and free to rotate with respect to valve body 207. Valve body 207 includes a valve seal 209 that is configured to provide a seal when seated in a valve seat in the tank (see FIG. 9). It will be appreciated that in the closed cap configurations illustrated in FIG. 7 and FIG. 8, the lever arm 203 is held in a downward rotated position by the slider 202, that lever arm 206 is held in an upward rotated position by its fixed connection to lever arm 203 via pinion 205, and that the valve assembly comprising valve seal 209 and valve seat is held open.

Figure 9:
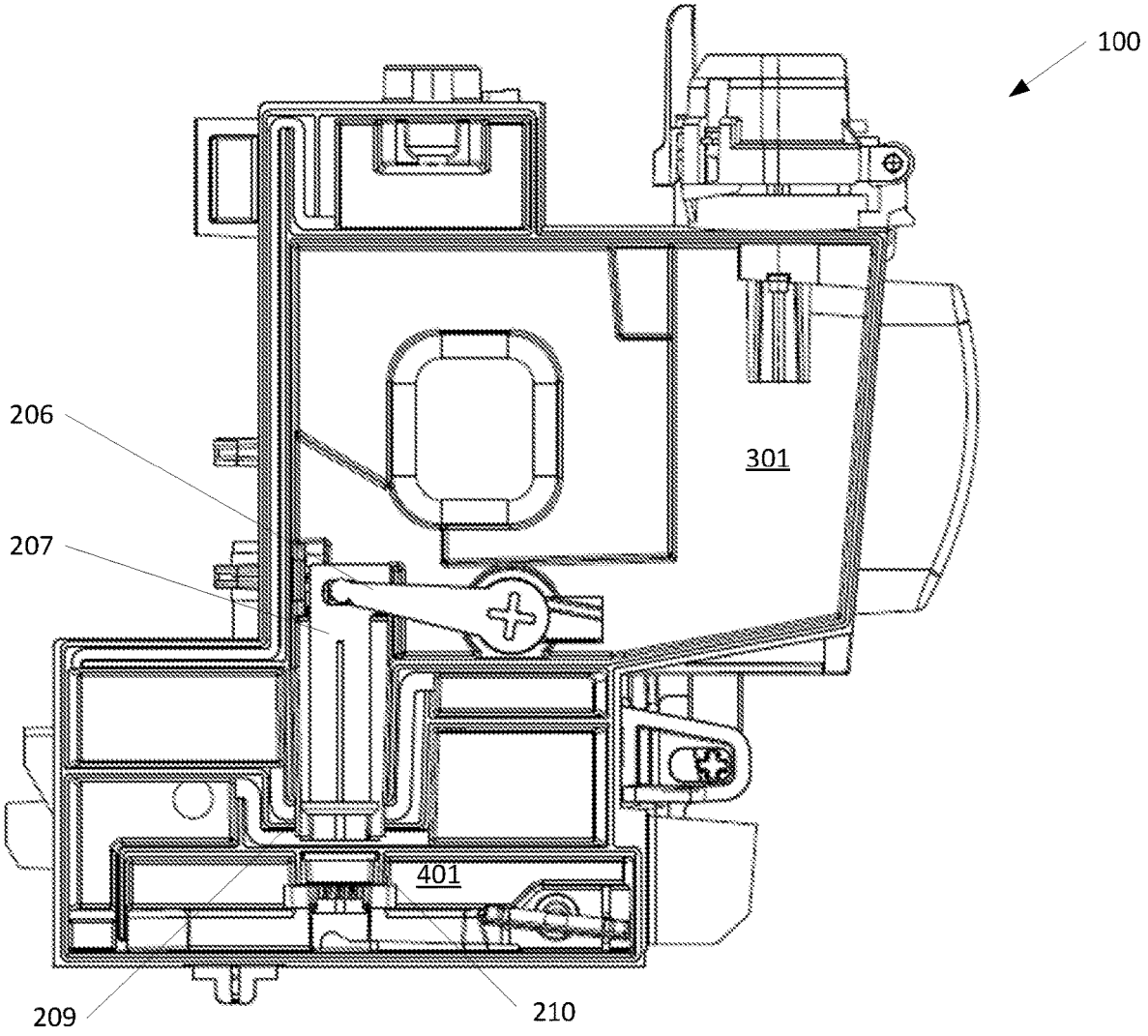
FIG. 9 is a sectional view of an example ink tank with a closed cap.

FIG. 9 is a sectional view of the example ink tank 100, showing internal details of the ink tank and the valve linkage described above in the closed cap configuration. In FIG. 9, lever arm 206 is in its upward rotated position, which translates through valve body 207 to an unseated valve seal 209 above valve seat 210. Also illustrated in FIG. 9 is an upper chamber 301 of ink tank body 101, and a lower chamber 401 of ink tank body 101, also referred to as a feeder tank. The valve assembly is positioned between the upper chamber 301 and the lower chamber 401 and permits fluid commination between the upper chamber 301 and the lower chamber 401.

Figure 10:
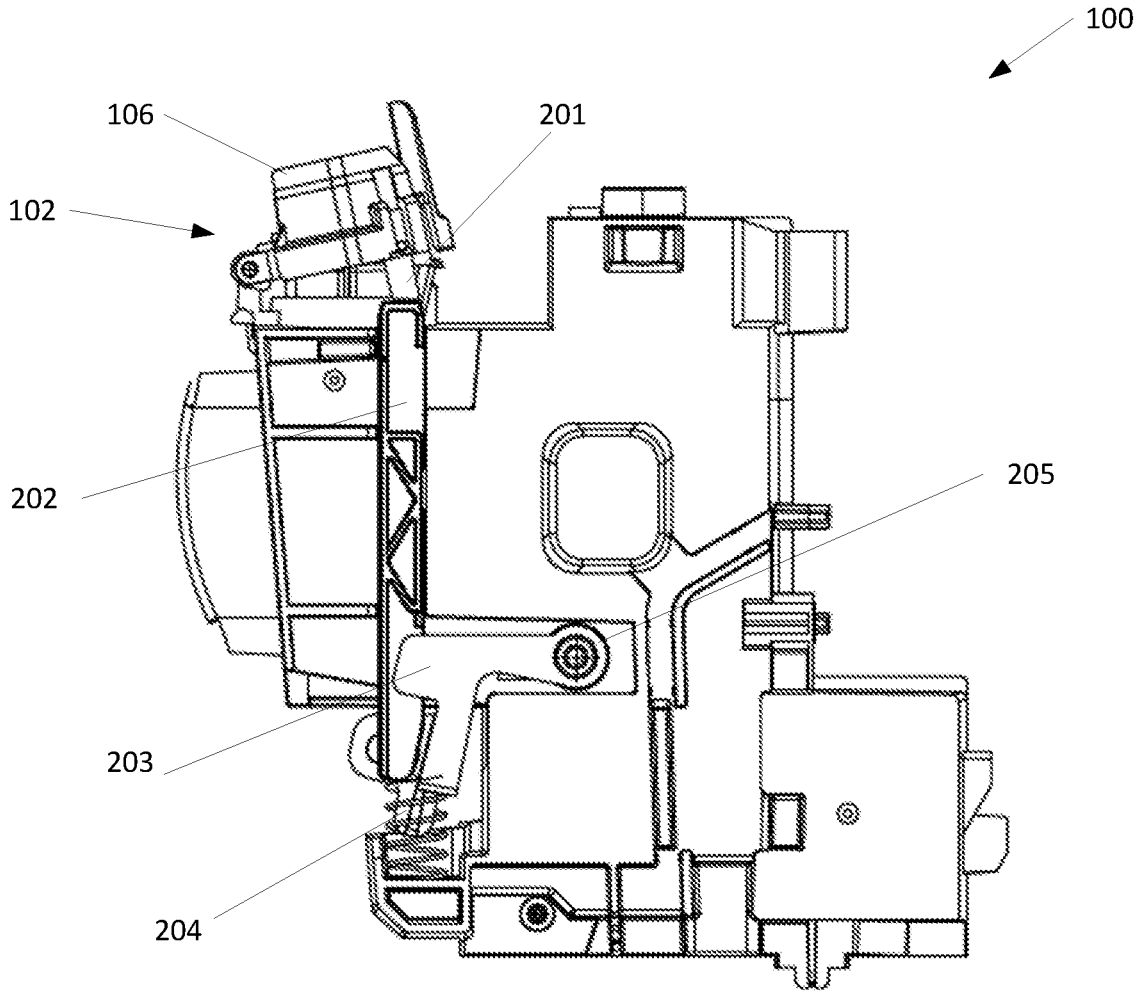
FIG. 10 is a side view of an example ink tank with a partially open cap.

Turning now to FIG. 10, there is illustrated a side view of the example ink tank 100 with the cap in the transient, partially open state described above. In this transient state, the cap assembly 102 is partially open, such that the cap housing 106 is partially rotated and the bung (107) to ink tank body (101) seal is maintained, but the holding force applied by effector 201 is removed from slider 202, which allows the force of spring 204 to rotate lever arm 203 upward (clockwise in FIG. 10). In one example, the angle of rotation of the cap assembly 102 relative to the closed position may be in the range of approximately 10 to 14 degrees.

Figure 11:
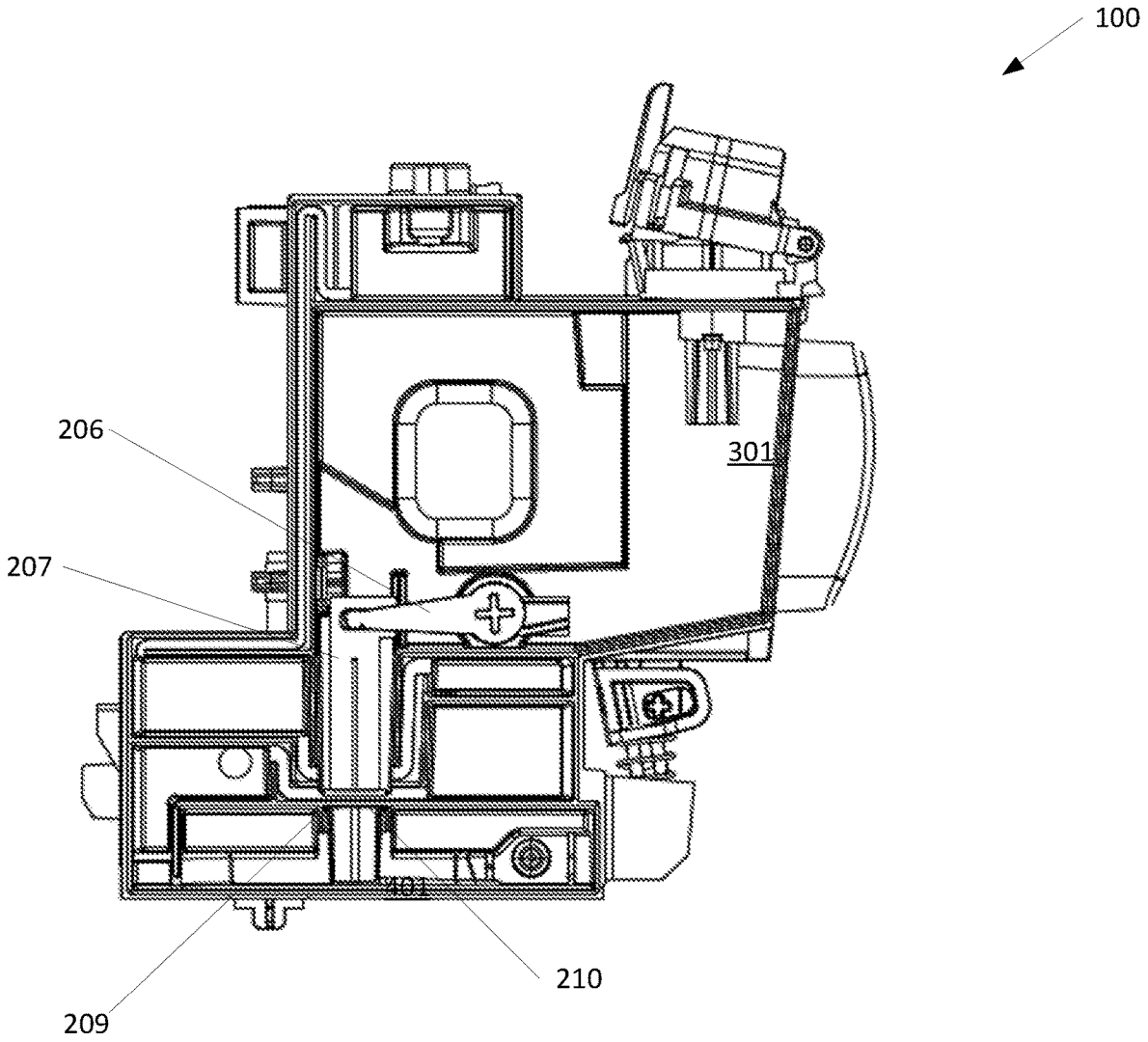
FIG. 11 is a sectional view of an example ink tank with a partially open cap.

FIG. 11 is a sectional view of the example ink tank 100, showing internal details of the ink tank and the valve linkage described above in the transient, partially open cap state. In FIG. 11, lever arm 206 is rotated downward, which translates through valve body 207 to seat valve seal 209 into value seat 210, thereby providing a seal between upper chamber 301 and lower chamber 401 and preventing fluid communication between the upper chamber 301 and the lower chamber 401.

Figure 12:
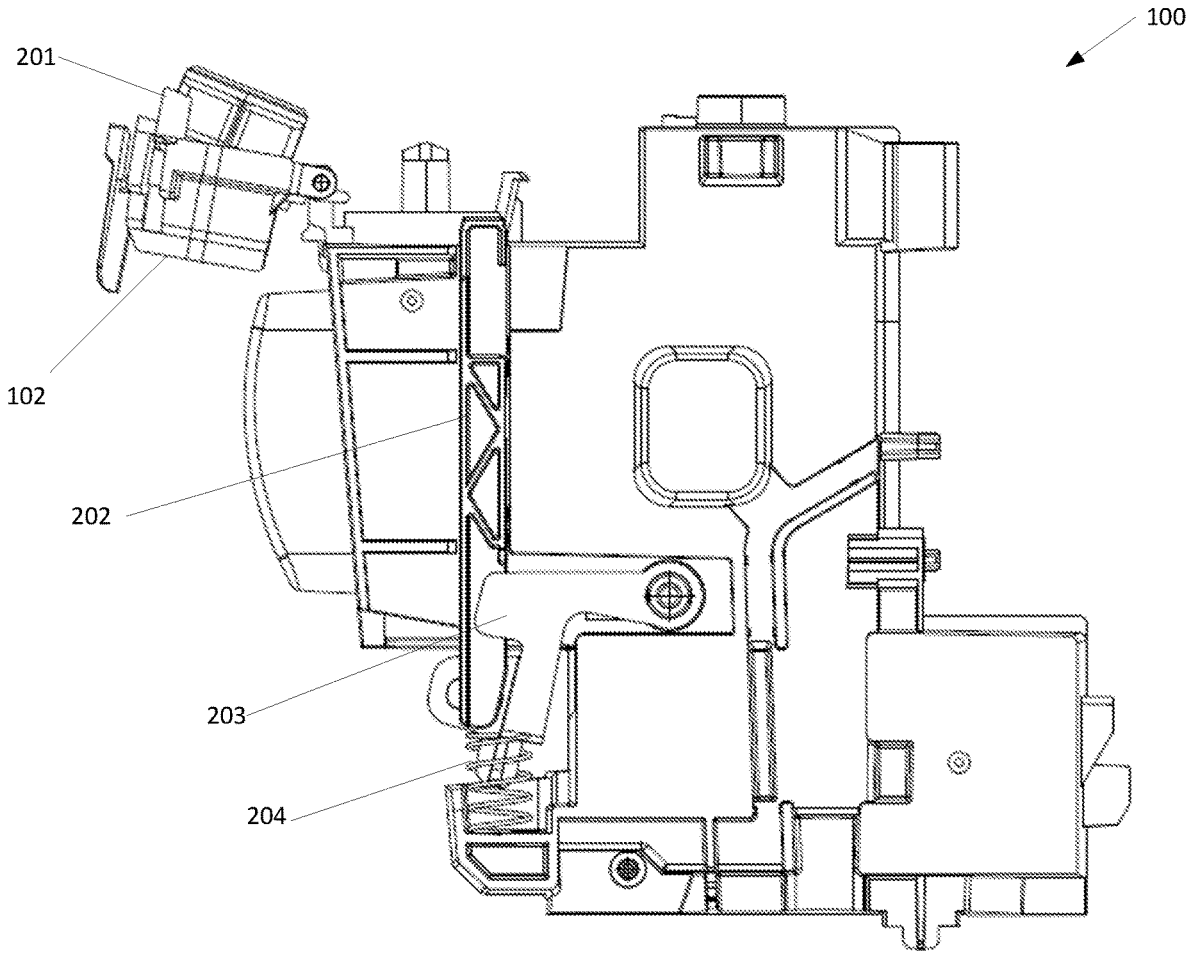
FIG. 12 is a side view of an example ink tank with a fully opened cap.

FIG. 12 illustrates the example ink tank 100 with the cap assembly rotated to its fully opened position under the force applied by the elastic band 104 described above. It will be appreciated that the internal seal between valve seal 209 and valve seat 210 will be maintained as the cap assembly 102 rotates from the transient position to the fully opened position because the effector 201 remains disengaged from the slider 202, allowing the spring 204 to hold the lever arm 203 in its upward rotated position. As described above, this position of lever arm 203 corresponds to the seating of valve seal 209 in valve seat 210.

As a result of the seal between the upper chamber 301 and the lower chamber 401, the sealed lower chamber 401 provides sufficient negative back pressure to prevent ink drool at the print head assembly, and the upper chamber may be filled.

From the foregoing description, it will be appreciated that the sequence of events that occurs when the cap is opened is reversible when the cap assembly 102 is closed by a user. Between the fully opened state and the transient state, the internal valve is closed and the upper chamber 301 of ink tank body 101 is not sealed by the bung 107. When the cap assembly reaches the transient position, the bung (107) seals the upper chamber 301 of ink tank body (101) and the effector 201 engages the slider 202. From the transient position to the closed position, the effector 201 depresses slider 202, which rotates lever arm 203 downward and lever arm 206 upward to unseat valve seal 209 from valve seat 210, reestablishing fluid communication between upper chamber 301 of ink tank body 101 and lower chamber 401 of ink tank body 101.

Figure 13:
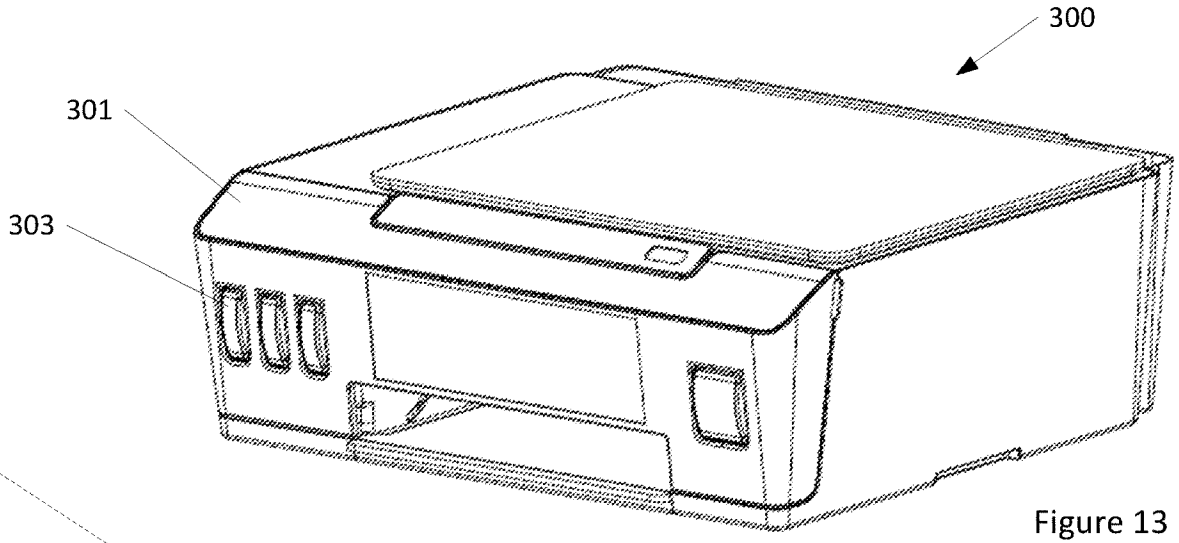
FIG. 13 is a perspective illustration of an example printer with a closed access door.

FIG. 13 illustrates an example printer 300 in which at least one ink tank, such as example ink tank 303 may be installed. Example printer 300 includes an access door 301 that provides access to installed ink tanks for filling or refilling.

Figure 14:
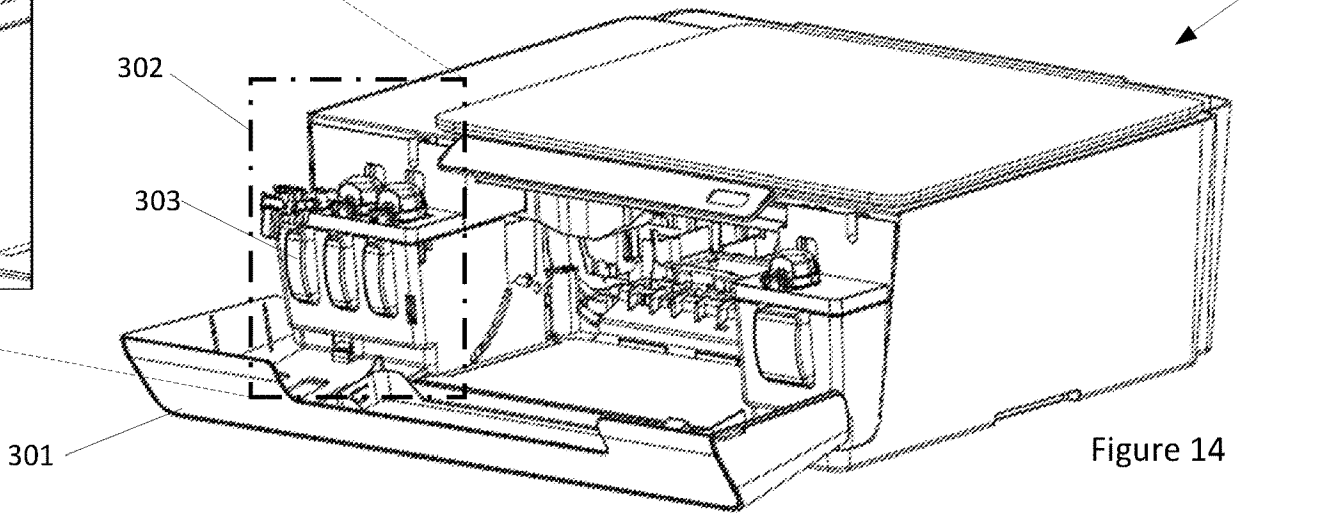
FIG. 14 is a perspective illustration of an example printer with an open access door.

FIG. 14 illustrates the example printer 300 with the access door 301 in an open position to allow access to an ink tank bay 302 containing the at least one ink tank 303 for filling or refilling. In one example, printer 300 includes an open-door sensor (not shown) that detects when the access door 301 is opened. The open door sensor may be any kind of sensor such as a mechanical switch, a magnetic switch, or the like. The open door sensor may be coupled to a print lockout circuit (not shown) that disables the print function of printer 300.

Figure 15:
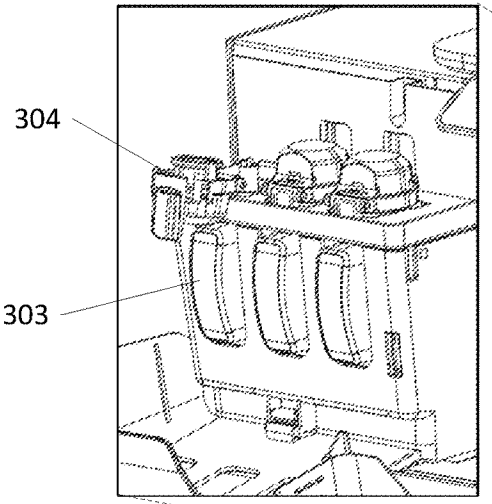
FIG. 15 is a perspective illustration of an example ink tank bay.

FIG. 15 is a magnified view of the ink tank bay 302 illustrating one of the example ink tanks 303 and a cap assembly 304 in a fully opened position. The example ink tank 303 and the cap assembly 304 may be similar to the example ink tank 100 and cap assembly 102 described above with reference to FIGS. 1-12. In this regard, a hinge is provided to connect the cap assembly 304 to the ink tank 303. Further, an elastic band is disposed around the hinge to apply an opening force to the cap assembly 304 when the cap assembly 304 is unlatched to bias the cap assembly 304 to a fully opened state, as illustrated in FIG. 15. The cap assembly 304 in the fully opened state prevents closure of the access door 301. As noted above, a door sensor may detect when the access door is open and may be coupled to a print lockout circuit to prevent printing when the access door is open. Thus, when the cap assembly 304 is in the fully opened state, printing is disabled.

Figure 16:
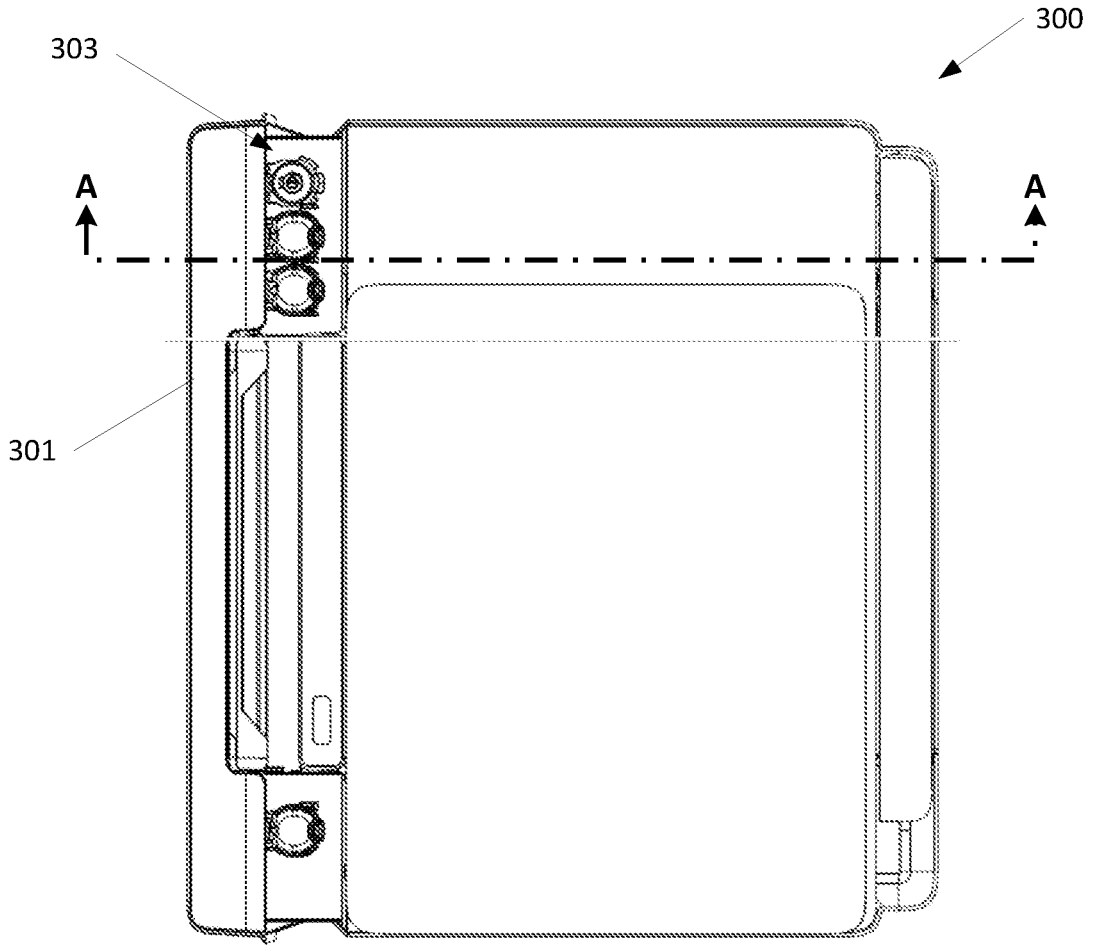
FIG. 16 is a top view of an example printer with access door interference.
Figure 17:
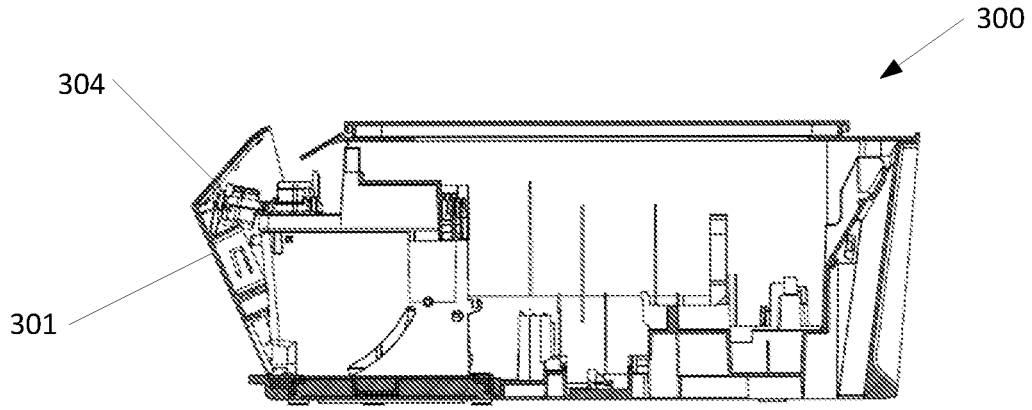
FIG. 17 is a sectional view of FIG. 16.

FIGS. 16 and 17 illustrate the example printer 300 with one of the example ink tank 303 in the fully opened position, where the cap assembly 304 prevents the closure of the access door 301. FIG. 16 is a top view of example printer 300 illustrating how the access door is prevented from closing and FIG. 17 is a cross-sectional view of printer 300 illustrating the interference of cap assembly 304 with access door 301. FIG. 17 is a cross-section of FIG. 16 illustrating the interference between the fully opened cap assembly 304 and the access door 301 that maintains the printer 300 in print lockout mode.

Figure 18:
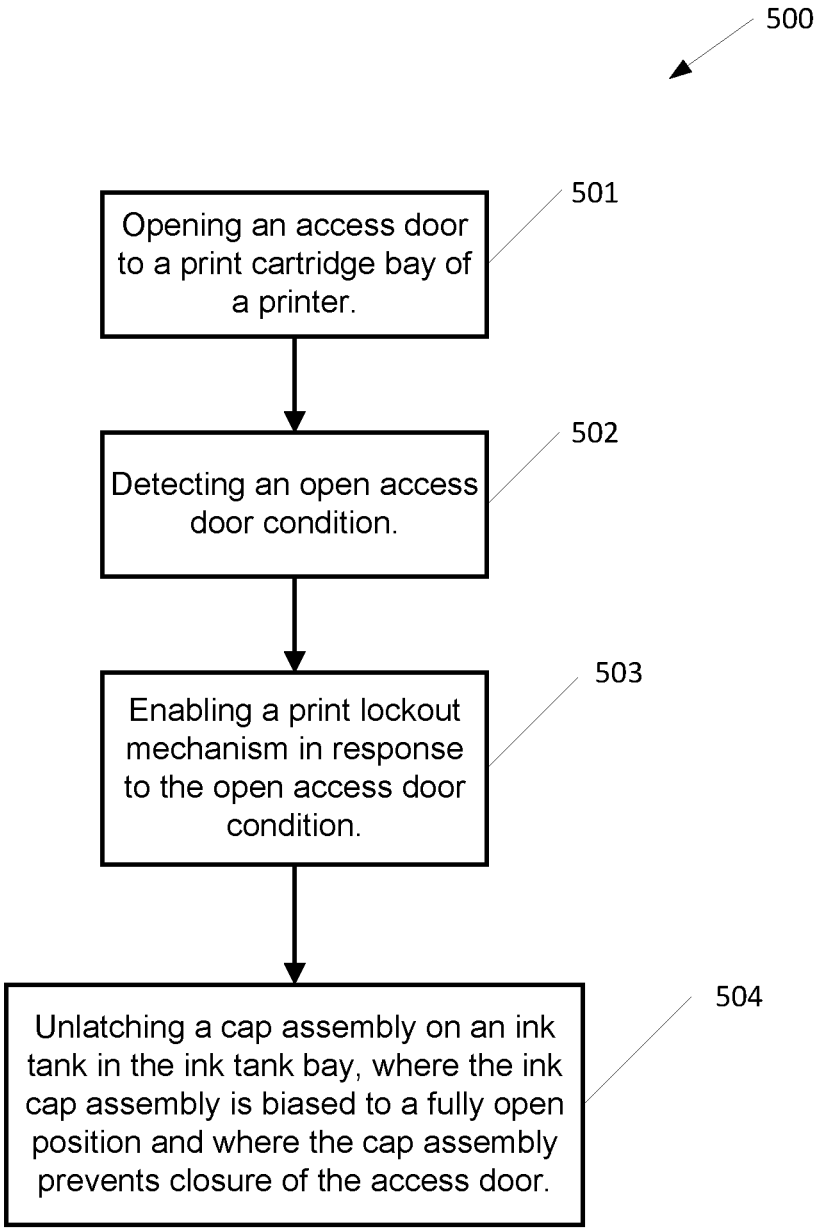
FIG. 18 is a flowchart illustrating an example method for printer lockout.

Referring now to FIG. 18, a flowchart illustrates an example method 500 for printer lockout in accordance with various examples described herein. The example method 500 includes opening an access door of a printer such as access door 301 of printer 300 in FIG. 14 (block 501). The example method 500 further includes detecting an open access door condition (block 502). For example, an open access door condition may be detected by a sensor, such as the open door sensor in example printer 300 described in relation to FIG. 14. Example method 500 continues (block 503) by enabling a print lockout mechanism in response to the open access door condition. For example, the open door sensor may be coupled to a print lockout circuit that disables electrical and mechanical functions of a print head assembly and prevents ink delivery to the print head assembly. Finally, the example method 500 includes unlatching a cap assembly on an ink tank in the ink tank bay, where the ink cap assembly is biased to a fully open position, and where the cap assembly prevents closure of the access door (block 504). For example, as described above and with respect to FIG. 17, cap assembly 102 of example ink tank 100 in ink tank bay 302 in FIG. 15 is biased to a fully open position that prevents closure of access door 301 in example printer 300.

Thus, in accordance with various examples described herein, printer lockout during ink filling operations may be achieved by an ink tank design that prevents an ink tank access door from closing when the ink tank is opened for filling. The printer lockout may include a sensor that detects when an access door to the ink tank bay is opened and disables the printing function. When an ink tank is unlatched for refilling, the cap of the ink tank is automatically forced to a fully opened state. In that fully opened state, the cap interferes with the access door and prevents it from closing, so the printing function cannot be enabled while the ink tank is open. In some examples, the ink tank may have an internal valve that closes when the cap is unlatched, but before the seal provided by the cap is broken. The internal valve may reduce or eliminate ink drool during ink refill operations.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described to explain the principles and the nature of various examples of the present disclosure and its practical application to enable one skilled in the art to use the present disclosure in various examples and with various modifications as are suited to the particular use contemplated. The features of the examples described herein may be combined in all possible combinations of methods, apparatus and systems.

It is also noted herein that while the above describes examples, these descriptions should not be viewed in a limiting sense. Rather, there are several variations and modifications which may be made without departing from the scope as defined in the appended claims.

What is claimed is:

1. An apparatus, comprising:

an ink tank comprising:

an ink tank body;

a cap assembly attached to the ink tank body by a hinge;

an elastic band disposed around the hinge to apply an opening force to the cap assembly; and a latch to hold the cap assembly in a closed position against the opening force, wherein the cap assembly is constrained to a closed state when latched, and a fully opened state when unlatched to prevent the closure of an access door of a printer when the ink tank is installed in the printer, effecting a printer lockout.

2. The apparatus of claim 1, further comprising a door sensor to detect when the access door is open, the door sensor coupled to a print lockout circuit to prevent printing when the access door is open, wherein printing is disabled when the cap assembly is in the fully opened state.

3. The apparatus of claim 1, wherein the ink tank body comprises an upper chamber and a lower chamber and a valve therebetween, the apparatus further comprising:

a spring-loaded linkage to apply a closing force to the valve when the cap assembly is in the fully opened state, wherein fluid communication between the upper chamber and the lower chamber is prevented; and an effector integral to the cap assembly to engage the spring-loaded linkage and to oppose the closing force when the cap assembly is in the closed state, wherein the valve is open when the cap assembly is latched and the upper chamber is in fluid communication with the lower chamber.

4. The apparatus of claim 1, wherein the cap assembly comprises:

a cap housing;

a bung retained within the cap housing; and a spring disposed between the cap housing and the bung, the spring to apply a sealing force between the bung and the ink tank body when the cap assembly is in the closed state.

5. The apparatus of claim 4, wherein the bung comprises an O-ring to provide the seal between the cap assembly and the ink tank body when the cap assembly is in the closed state.

6. The apparatus of claim 4, wherein the cap housing is fabricated from an acetal homopolymer thermoplastic.

7. The apparatus of claim 4, wherein the bung is fabricated from an elastic polymer.

8. A method, comprising:

opening an access door to an ink tank bay of a printer;

detecting an open access door condition;

enabling a print lockout mechanism in response to the open access door condition; and unlatching a cap assembly of an ink tank in the ink tank bay, wherein the cap assembly is attached to the ink tank by a hinge, wherein the cap assembly is biased to a fully open position, and wherein the cap assembly in the fully open position prevents closure of the access door.

9. The method of claim 8, further comprising:

filling the ink tank;

closing and latching the cap assembly to permit closing of the access door; and closing the access door to enable printing.

10. The method of claim 8, wherein unlatching the cap assembly closes an internal valve between an upper chamber and a lower chamber of the ink tank to prevent flooding of a print head assembly (PHA) when the ink tank is being filled.

11. The method of claim 10, wherein closing and latching the cap assembly opens the internal valve to establish fluid communication between the upper chamber and the lower chamber.

12. A system, comprising:

a printer;

an access door of the printer to provide access to an ink tank bay;

at least one ink tank, each tank comprising a cap assembly, a hinge connecting the cap assembly to the ink tank, and an elastic band disposed around the hinge to apply an opening force to the cap assembly when the cap assembly is unlatched to bias the cap assembly to a fully opened state, wherein the cap assembly in the fully opened state prevents closure of the access door; and a door sensor to detect when the access door is open, the door sensor coupled to a print lockout circuit to prevent printing when the access door is open, wherein printing is disabled when the cap assembly is in the fully opened state.

13. The system od claim 12, wherein the cap assembly comprises a latch to hold the cap assembly in a closed state against the opening force applied by the elastic band.

14. The system of claim 13, wherein the ink tank comprises an upper chamber and a lower chamber and a valve therebetween, the ink tank further comprising:

a spring-loaded linkage to apply a closing force to the valve when the cap assembly is in the fully opened state; and an effector integral to the cap assembly to engage the spring-loaded linkage and to oppose the closing force when the cap assembly is in the closed state, wherein the valve is open when the cap assembly is latched and the upper chamber is in fluid communication with the lower chamber.

15. The system of claim 14, wherein the cap assembly comprises:

a cap housing;

a bung retained within the cap housing; and a spring disposed between the cap housing and the bung, the spring to apply a sealing force between the bung and the ink tank when the cap is in the closed state.

* * * * *